US008667718B2

(12) United States Patent
Lang

(10) Patent No.: US 8,667,718 B2
(45) Date of Patent: Mar. 11, 2014

(54) VEHICLE SIGN

(75) Inventor: Dawn Lang, Chicago, IL (US)

(73) Assignee: Dreams Realized LLC, Dover, DE (US)

( * ) Notice: Subject to any disclaimer, the term of this patent is extended or adjusted under 35 U.S.C. 154(b) by 0 days.

(21) Appl. No.: 13/452,761

(22) Filed: Apr. 20, 2012

(65) Prior Publication Data

US 2013/0276340 A1 Oct. 24, 2013

(51) Int. Cl.
*G09F 11/18* (2006.01)

(52) U.S. Cl.
USPC ..... 40/515; 40/590; 40/591

(58) Field of Classification Search
USPC ..... 40/515, 590, 514
See application file for complete search history.

(56) References Cited

U.S. PATENT DOCUMENTS 5,373,655 A * 12/1994 Suzuki ..... 40/603
6,170,182 B1 * 1/2001 Skypala ..... 40/514
7,350,325 B1 * 4/2008 Wang ..... 40/515
7,428,792 B2 * 9/2008 Kochan et al. ..... 40/586
7,530,187 B1 * 5/2009 Dreka ..... 40/591
2004/0025391 A1 * 2/2004 Storm ..... 40/591

FOREIGN PATENT DOCUMENTS

WO WO 2009023654 A1 * 2/2009 ..... G09F 21/04

* cited by examiner

*Primary Examiner* — Kristina Junge
(74) *Attorney, Agent, or Firm* — Drinker Biddle & Reath LLP

(57) ABSTRACT

Embodiments of the present disclosure include an apparatus for displaying sign on a vehicle, the apparatus having a first sleeve and a second sleeve. Further, the apparatus may include one or more first sleeve fasteners capable of being coupled to the first sleeve and one or more second sleeve fasteners capable of being coupled to the second sleeve. In addition, the apparatus may have a main housing capable of being fastened to the first sleeve and a receiving housing capable of being fastened to the second sleeve. Also, a winding mechanism may be coupled to the main housing and indirectly or direct coupled to the first sleeve. Moreover, such an apparatus may include a rollable vehicle sign capable of rolling and unrolling on the winding mechanism, a first end of the vehicle sign coupled to the winding mechanism and a second end coupled to the receiving housing.

19 Claims, 9 Drawing Sheets

RIGHT SIDE VIEW

LEFT SIDE VIEW

VEHICLE SIGN

BACKGROUND

Both commercial and personal vehicles may break down suddenly or conduct an emergency stop on the side of a busy street or highway. In such situations, drivers of the personal or commercial vehicle would like to attach a sign to the rear of the vehicle to indicate approaching vehicles of such an emergency stop so that may be aware of any potential risk. Such emergency indicating signs or special cargo indicating signs reduce the risk of accident involving such vehicles and increase overall traffic safety.

Vehicle signs are available to be placed temporarily or permanently on personal and commercial vehicles to indicate such emergencies or special cargo. However, most signs are not securely fastened to the vehicle and susceptible to wind shear when the vehicle is moving or weather related elements (wind, rain, snow, etc.) such that their use may be limited. Further, most signs are not portable such that they may be used among different vehicles. For example, a family may have two or more vehicles and such a portable sign may have a need to be moved from one vehicle to another if the driver foresees the need of such a sign due to the carrying any special cargo to driving in potential dangerous weather conditions. Alternatively, a small business may have a need to share such special cargo signs among their small fleet of delivery trucks depending on the nature of the cargo and the foreseeable safety concerns.

BRIEF SUMMARY

Aspects of the present disclosure address the deficiencies of emergency or special cargo signage by describing a vehicle sign that may be securely fastened to a personal or commercial vehicle either permanently or temporarily to withstand wind shear or weather elements (wind, rain, snow, ice, etc.) and also is able to be portable to be shared among different vehicles.

Embodiments of the present disclosure include an apparatus for displaying sign on a vehicle, the apparatus having a first sleeve and a second sleeve. Further, the apparatus may include one or more first sleeve fasteners capable of being coupled to the first sleeve and one or more second sleeve fasteners capable of being coupled to the second sleeve. In addition, the apparatus may have a main housing capable of being fastened to the first sleeve and a receiving housing capable of being fastened to the second sleeve. Also, a winding mechanism may be coupled to the main housing and indirectly or direct coupled to the first sleeve. Moreover, such an apparatus may include a rollable vehicle sign capable of rolling and unrolling on the winding mechanism, a first end of the vehicle sign coupled to the winding mechanism and a second end coupled to the receiving housing.

Further, the apparatus displays the vehicle sign upon fastening the main housing to the first sleeve and fastening the receiving housing to the second sleeve. In addition, the apparatus includes a first handle coupled to the main housing and a second handle coupled to the receiving housing. Also, the main housing and the receiving housing are capable of being fastened together using one or more housing fasteners. The handles and capability of the main housing and the receiving housing being able to be fastened together allows the apparatus to be portable. Further, the one or more first sleeve fasteners, one or more second sleeve fasteners, and one or more housing fasteners can be selected from the group consisting of bolts, nuts, screws, magnets, clamps, clips, adhesive material, or any combination thereof.

Embodiments of the present disclosure include a system for displaying sign on a vehicle, the system includes a main housing and a receiving housing. Further, the system includes a winding mechanism coupled to the main housing and a rollable vehicle sign capable of rolling and unrolling on the winding mechanism, a first end of the vehicle sign coupled to the winding mechanism and a second end coupled to the receiving housing. In addition, the system may include a first sleeve capable of being fastened to the winding mechanism directly or indirectly through the main housing and a second sleeve capable of being fastened to the receiving housing as well as one or more first sleeve fasteners capable of being coupled to the first sleeve and one or more second sleeve fasteners capable of being coupled to the second sleeve. Also, the system displays the vehicle sign upon fastening the main housing to the first sleeve and fastening the receiving housing to the second sleeve.

Further, the system may include a first handle coupled to the main housing and a second handle coupled to the receiving housing. In addition, the main housing and the receiving housing are capable of being fastened together using one or more housing fasteners. The handles and the ability for the main housing and the receiving housing being fastened together allow the system to be portable. Further, the one or more first sleeve fasteners, one or more second sleeve fasteners, and one or more housing fasteners can be selected from the group consisting of bolts, nuts, screws, magnets, clamps, clips, adhesive material, or any combination thereof.

Embodiments of the present disclosure also include an example method for displaying sign on a vehicle such that the example method includes the steps of fastening a first sleeve to the vehicle using one or more first sleeve fasteners and fastening a second sleeve to the vehicle using one or more second sleeve fasteners as well as coupling a main housing to the first sleeve and coupling a receiving housing to the second sleeve. The example method may also include displaying the sign when across a portion of the vehicle when the main housing is coupled to the first sleeve and the receiving housing is coupled to the second sleeve. In addition, a first handle may be coupled to the main housing and a second handle may be coupled to the receiving housing. Other steps in the example method may be decoupling the main housing from the first sleeve and decoupling from the receiving housing to the second sleeve and coupling the main housing to the receiving housing using one or more housing fasteners. The handles and the ability for the main housing and the receiving housing being fastened together allow the system to be portable. Further, the one or more first sleeve fasteners, one or more second sleeve fasteners, and one or more housing fasteners can be selected from the group consisting of bolts, nuts, screws, magnets, clamps, clips, adhesive material, or any combination thereof.

The foregoing summary is illustrative only and is not intended to be in any way limiting. In addition to the illustrative aspects, embodiments, and features described above, further aspects, embodiments, and features will become apparent by reference to the drawings and the following detailed description

BRIEF DESCRIPTION OF THE SEVERAL VIEWS OF THE DRAWINGS

The accompanying drawings, which are incorporated in and constitute part of this specification, illustrate embodiments of the invention and together with the description serve to explain the principles of the present disclosure. The embodiments illustrated herein are presently preferred, it being understood, however, that the invention is not limited to the precise arrangements and instrumentalities shown, wherein.

DETAILED DESCRIPTION OF THE INVENTION

Figure 1:
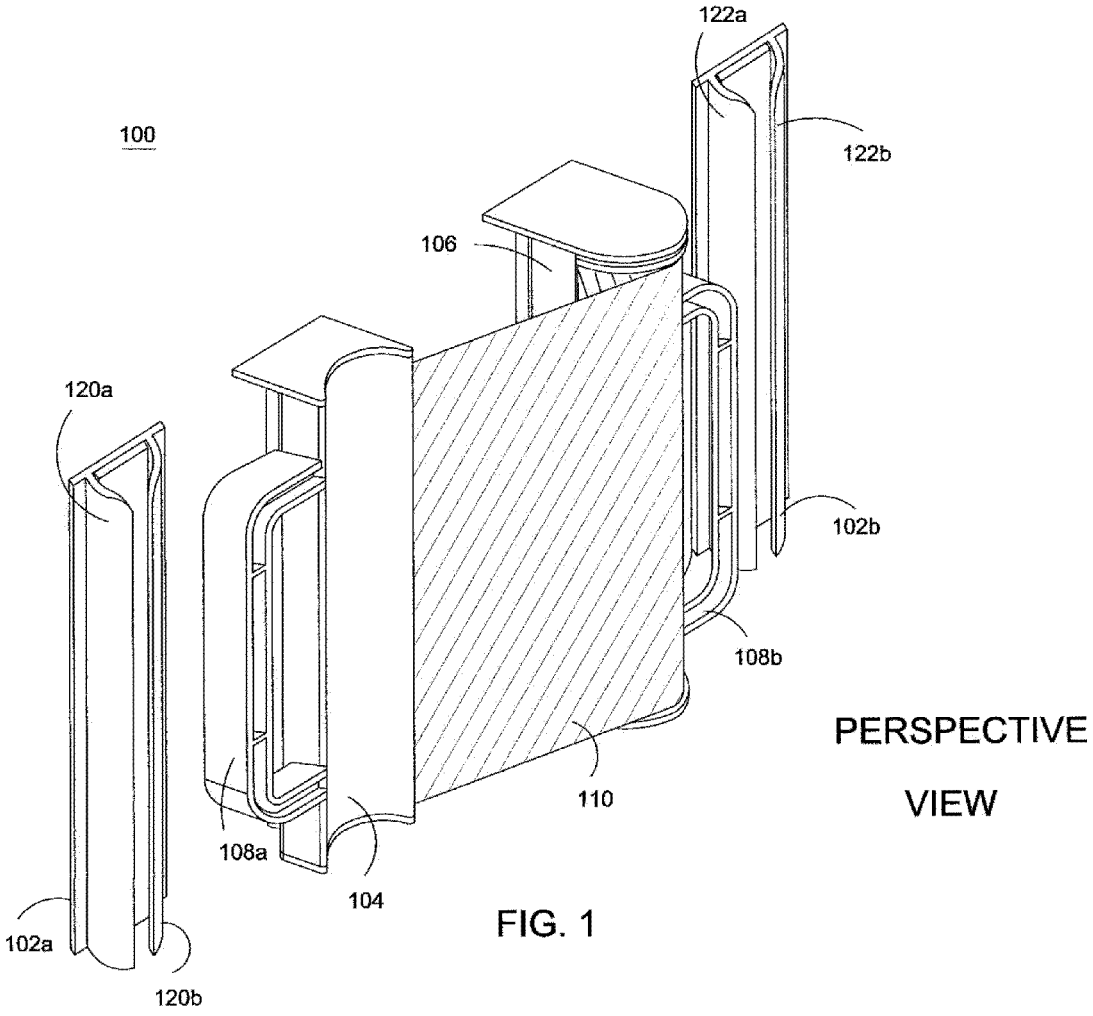
FIG. 1 is a perspective view of an exemplary embodiment of a vehicle sign.

In the following detailed description, reference is made to the accompanying drawings, which for a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of difference configurations, all of which are explicitly contemplated herein. Further, in the following description, numerous details are set forth to further describe and explain one or more embodiments. These details include system configurations, block module diagrams, flowcharts (including transaction diagrams), and accompanying written description. While these details are helpful to explain one or more embodiments of the disclosure, those skilled in the art will understand that these specific details are not required in order to practice the embodiments.

FIG. 1 is a perspective view 100 of an exemplary embodiment of a vehicle sign. Components of such a vehicle sign may include a rollable sign 110 having a first end and a second end. The first end of the rollable sign 110 may be attached, coupled or fastened to a main housing 106. The second end of the rollable sign 110 may be attached, coupled or fastened to a receiving housing 104. Further a handle 108*a* is attached, fastened or coupled to the receiving housing 104 and another handle is attached, coupled or fastened to the main housing. Also depicted in FIG. 1 are two sleeves. A receiving housing sleeve 102*a* may have a right sleeve 120*a* and a left sleeve 120*b*. Further, a main housing sleeve 102*b* may have a right sleeve 122*a* and a left sleeve 122*b*.

Sleeves 102*a* and 102*b* may be fastened to a vehicle bumper or panel such that they are sufficiently spaced apart. Further, upon fastening the receiving housing and the main housing to the receiving housing sleeve 102*a* and main housing sleeve 102*b*, the rollable sign 110 is extended and displayed.

Figure 2:
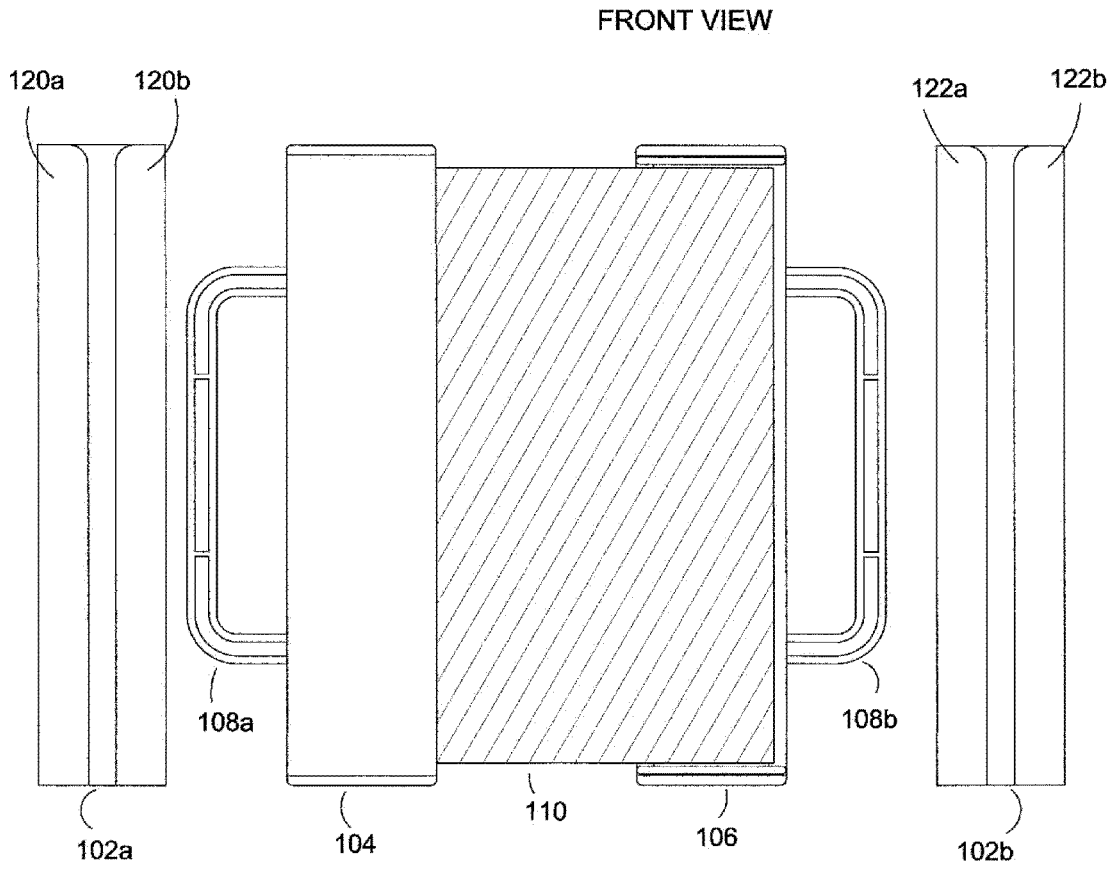
FIG. 2 is a front view of an exemplary embodiment of a vehicle sign.

FIG. 2 is a front view of an exemplary embodiment of a vehicle sign and depicts the same components as FIG. 1 but through a different view. That is, components of such a vehicle sign may include a rollable sign 110 having a first end and a second end. The first end of the rollable sign 110 may be attached, coupled or fastened to a main housing 106. The second end of the rollable sign 110 may be attached, coupled or fastened to a receiving housing 104. Further a handle 108*a* is attached, fastened or coupled to the receiving housing 104 and another handle is attached, coupled or fastened to the main housing. Also depicted in FIG. 1 are two sleeves. A receiving housing sleeve 102*a* may have a right sleeve 120*a* and a left sleeve 120*b*. Further, a main housing sleeve 102*b* may have a right sleeve 122*a* and a left sleeve 122*b*. As can be shown by the sleeves 102*a* and 102*b*, they are made to withstand weather conditions. Rain, snow and ice, would not impede the main housing 106 and receiving housing 104 to be fastened to the sleeves (102*a* and 102*b*).

Figure 3:
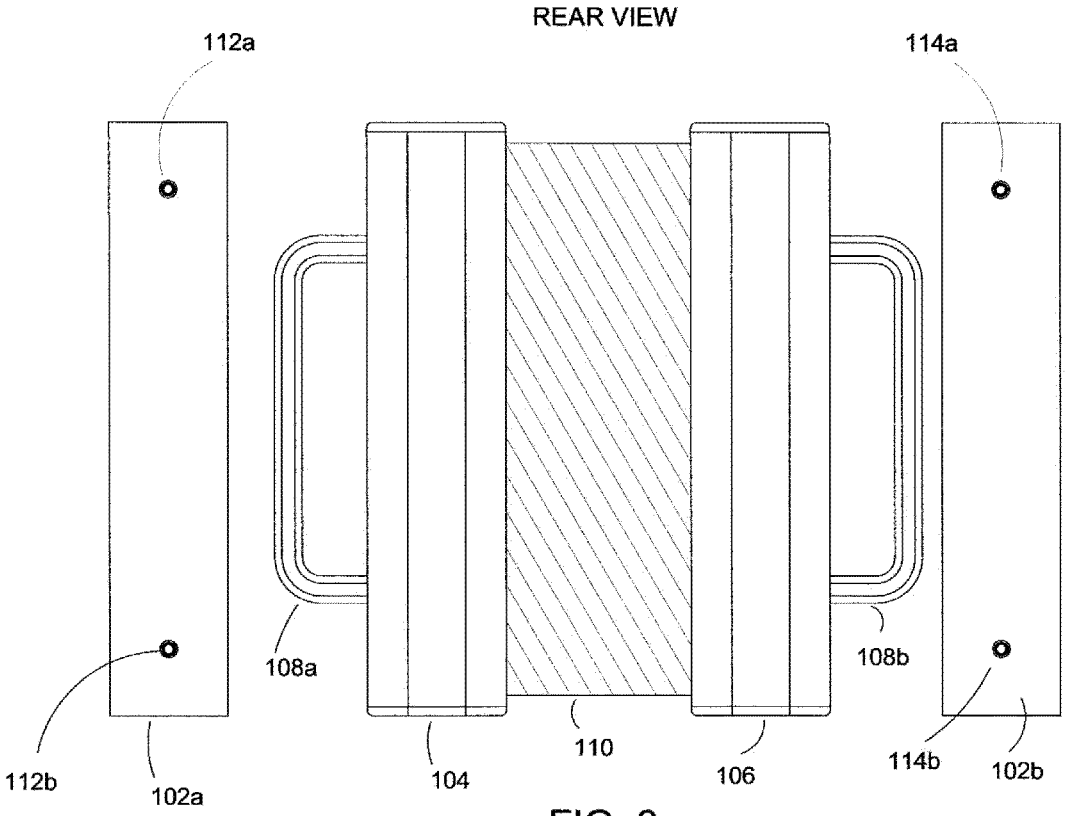
FIG. 3 is a rear view of an exemplary embodiment of a vehicle sign

FIG. 3 is a rear view of an exemplary embodiment of a vehicle sign and has similar components as shown in FIGS. 1 and 2. That is, components of such a vehicle sign may include a rollable sign 110 having a first end and a second end. The first end of the rollable sign 110 may be attached, coupled or fastened to a main housing 106. The second end of the rollable sign 110 may be attached, coupled or fastened to a receiving housing 104. Further a handle 108*a* is attached, fastened or coupled to the receiving housing 104 and another handle is attached, coupled or fastened to the main housing 106. Also depicted in FIG. 1 are two sleeves, a receiving housing sleeve 102*a* and a main housing sleeve 102*b*.

However, FIG. 3 shows additional components to the vehicle sign that include main housing sleeve fasteners (112*a* and 112*b*) and receiving housing fasteners (114*a* and 114*b*). Such fasteners (112*a*, 112*b*, 114*a*, and 114*b*) may be bolts, nuts, screws, magnets, clamps, clips, adhesive material, or any combination thereof and can be used to fasten the sleeves (102*a* and 102*b*) to a vehicle front or rear bumper or side panel. Further, the fasteners (112*a*, 112*b*, 114*a*, and 114*b*) are able to withstand weather conditions and securely fasten the vehicle sign to the vehicle.

Figure 4:
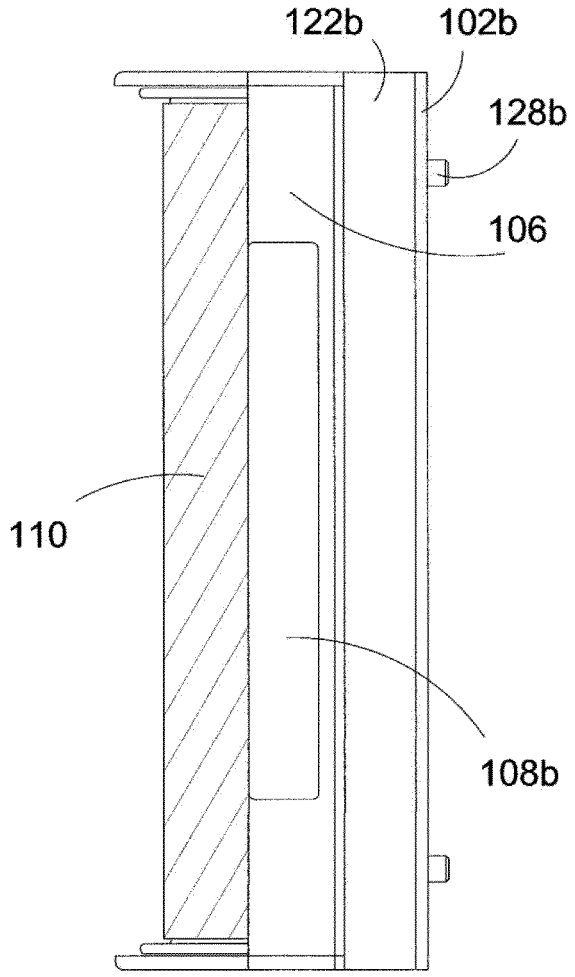
FIG. 4 is a right side view of an exemplary embodiment of a vehicle sign.

FIG. 4 is a right side view of an exemplary embodiment of a vehicle sign and has similar components as shown in FIGS. 1 and 2. That is, components of such a vehicle sign may include a rollable sign 110 having a first end and a second end. The first end of the rollable sign 110 may be attached, coupled or fastened to a main housing 106. Further a handle 108*b* to the main housing 106. Also depicted in FIG. 4 is main housing sleeve 102*b*. In addition, FIG. 4 shows sleeve fastener 128*b* which may be bolts, nuts, screws, magnets, clamps, clips, adhesive material, or any combination thereof and can be used to fasten the sleeve 102*b* to a vehicle front or rear bumper or side panel.

Figure 5:
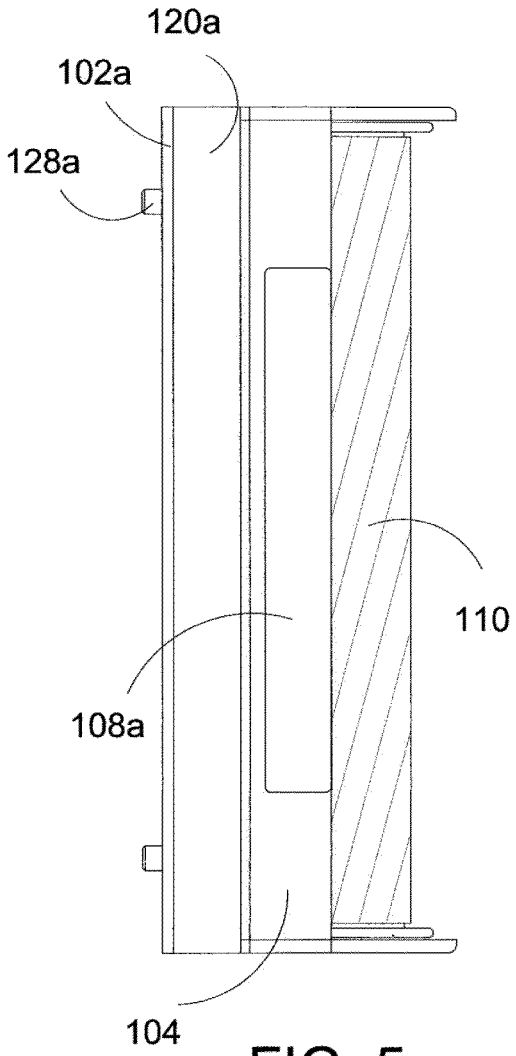
FIG. 5 is a left side view of an exemplary embodiment of a vehicle sign.

FIG. 5 is a left side view of an exemplary embodiment of a vehicle sign and has similar components as shown in FIGS. 1 and 2. That is, components of such a vehicle sign may include a rollable sign 110 having a first end and a second end. The second end of the rollable sign 110 may be attached, coupled or fastened to a receiving mechanism housing 104. Further a handle 108*a* to the receiving housing 104. Also depicted in FIG. 5 is receiving housing sleeve 102*b*. In addition, FIG. 4 shows sleeve fastener 128*a* which may be bolts, nuts, screws, magnets, clamps, clips, adhesive material, or any combination thereof and can be used to fasten the sleeve 102*b* to a vehicle front or rear bumper or side panel.

Figure 6:
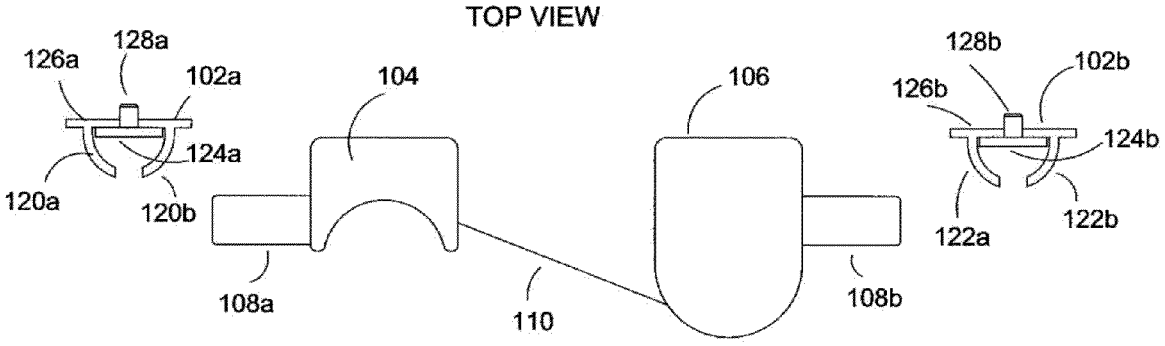
FIG. 6 is a top view of an exemplary embodiment of a vehicle sign.
Figure 7:
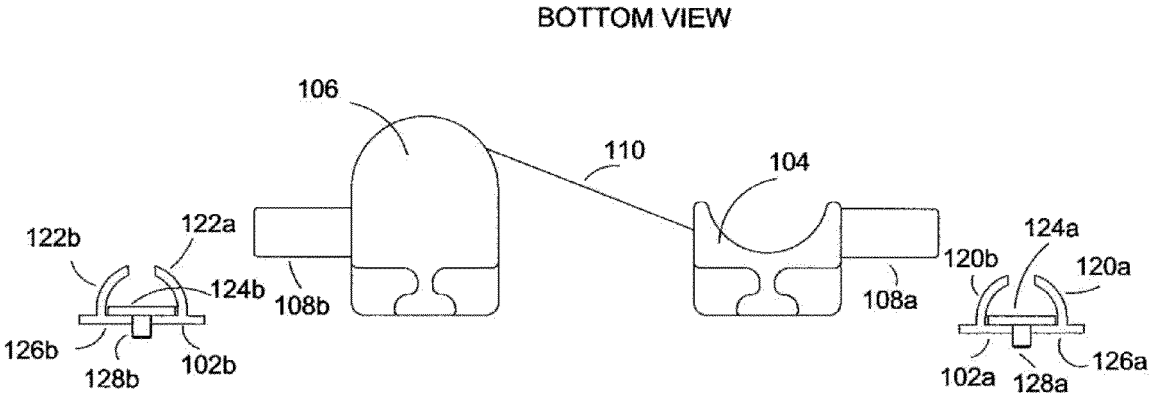
FIG. 7 is a bottom view of an exemplary embodiment of a vehicle sign.

FIG. 6 is a top view of an exemplary embodiment of a vehicle sign and has similar components as shown in FIGS. 1-5 but also includes sleeve backs (126*a* and 126*b*) and sleeve fronts (124*a* and 124*b*). FIG. 7 is a bottom view of an exemplary embodiment of a vehicle sign and has similar components as shown in FIGS. 1-6.

Figure 8:
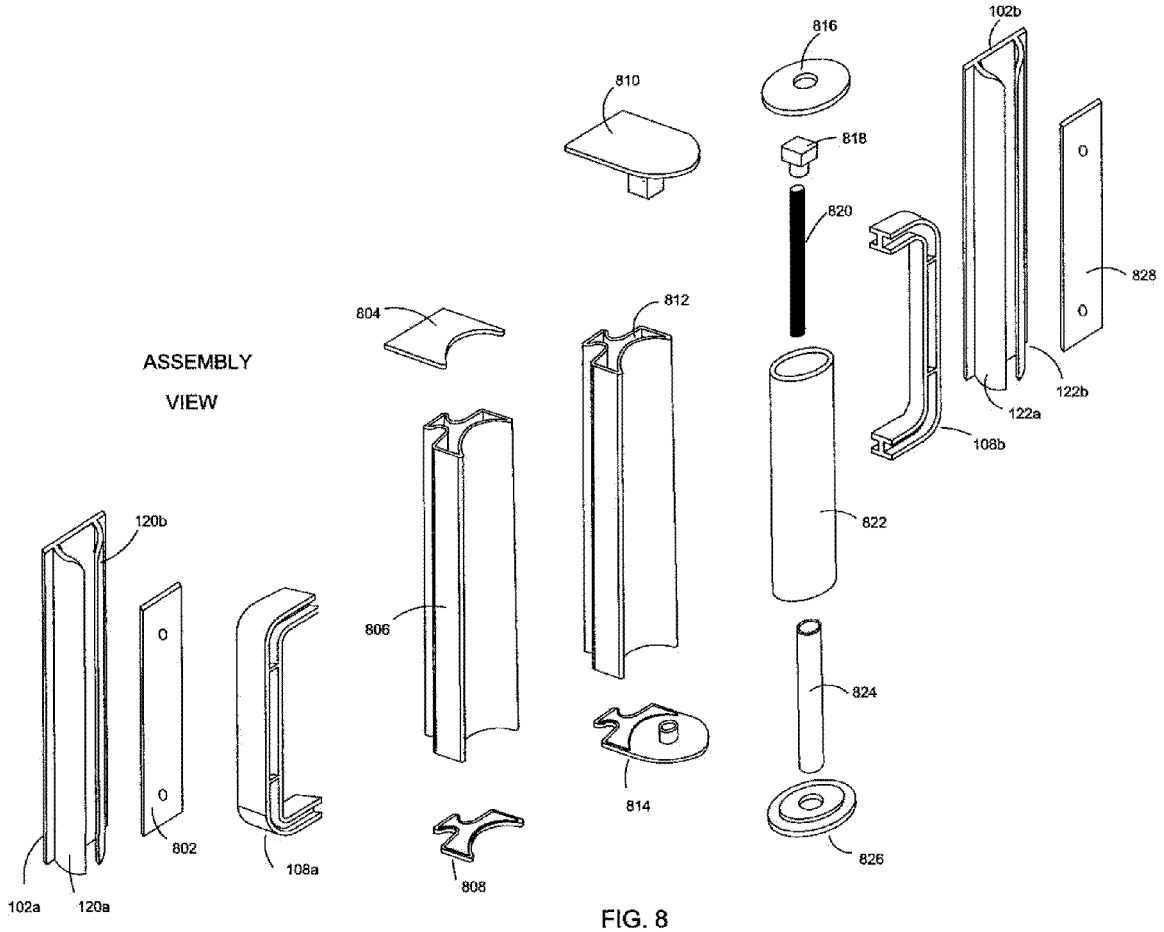
FIG. 8 is an assembly view of an exemplary embodiment of a vehicle sign.

FIG. 8 is an assembly view of an exemplary embodiment of a vehicle sign and has similar components as shown in FIGS. 1-6. Such components include receiving housing sleeve 102*a* with right sleeve 120*a* and left sleeve 120*b*. Further, there may be included a fastening panel 802 to facilitate fastening of the receiving sleeve 102*a* to a vehicle bumper or panel. In addition, a receiving housing may include a receiving body 806 with a top cap 804 and bottom cap 808. Also, a main housing may include a body 812 with top cap 810 and bottom cap 814. Further, the winding mechanism may include an outer roller 822 and an inner roller 824 with spool 820 and spool fastener 818. The winding mechanism also includes a top cap 816 and bottom cap 826. A handle 108*b* may be fastened to the main housing. In addition, the main housing sleeve 102*b* may include a right sleeve 122*a* and left sleeve 122*b* with fastening panel 828 to fasten the sleeve 102*b* to a vehicle bumper or panel.

Figure 9:
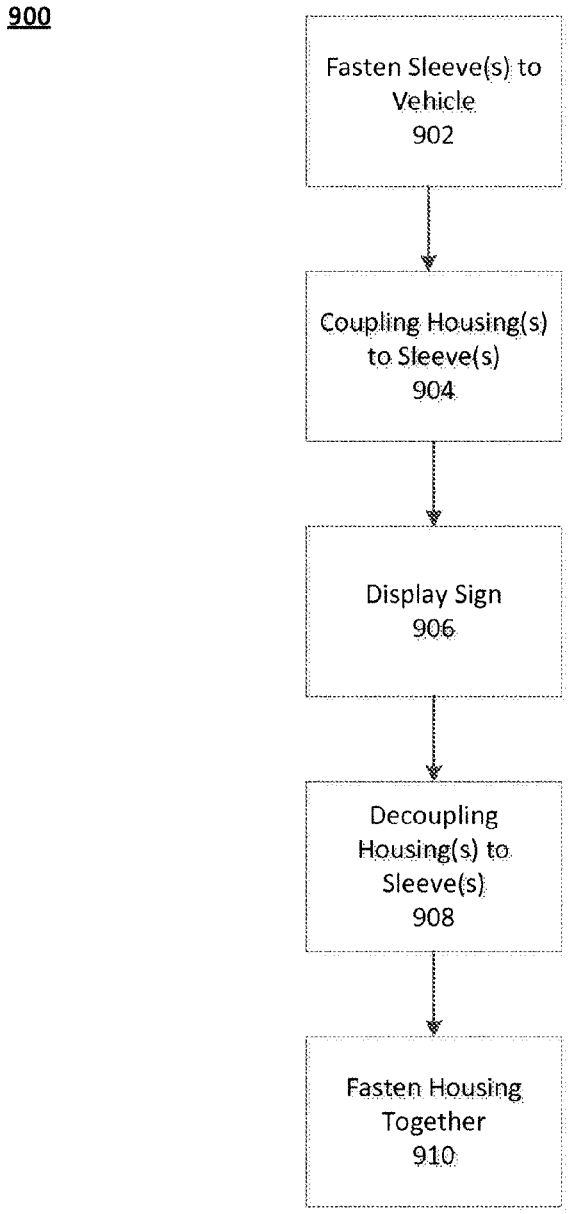
FIG. 9 is a flowchart of an example method according to aspects of the present disclosure.

FIG. 9 is a flowchart of an example method 900 according to aspects of the present disclosure. A step in the example method may include fastening a main housing sleeve to the vehicle using one or more main housing sleeve fasteners and fastening a second sleeve to the vehicle using one or more receiving housing sleeve fasteners, as shown in block 902. A further step may be coupling a main housing to the main housing sleeve and coupling a receiving housing to the receiving housing sleeve, as shown in block 904. An additional step may be displaying the sign when across a portion of the vehicle when the main housing is coupled to the main housing sleeve and the receiving housing is coupled to the receiving sleeve, as shown in block 906. Other components to the sign may include a handle coupled to the main housing and another handle coupled to the receiving housing. Another step in the example method may include decoupling the main housing from the main housing sleeve and decoupling from the receiving housing to the receiving sleeve such that an apparatus formed when coupling the main housing to the receiving housing is portable, as shown in block 908. A further step may be coupling the main housing to the receiving housing using one or more housing fasteners, as shown in block 910. Such housing and sleeve fasteners can include bolts, nuts, screws, magnets, clamps, clips, adhesive material, or any combination thereof.

Note that the functional blocks, methods, devices and systems described in the present disclosure may be integrated or divided into different combination of systems, devices, and functional blocks as would be known to those skilled in the art.

In general, it should be understood that the circuits described herein may be implemented in hardware using integrated circuit development technologies, or yet via some other methods, or the combination of hardware and software objects that could be ordered, parameterized, and connected in a software environment to implement different functions described herein. For example, the present application may be implemented using a general purpose or dedicated processor running a software application through volatile or non-volatile memory. Also, the hardware objects could communicate using electrical signals, with states of the signals representing different data It should be further understood that this and other arrangements described herein are for purposes of example only. As such, those skilled in the art will appreciate that other arrangements and other elements (e.g. machines, interfaces, functions, orders, and groupings of functions, etc.) can be used instead, and some elements may be omitted altogether according to the desired results. Further, many of the elements that are described are functional entities that may be implemented as discrete or distributed components or in conjunction with other components, in any suitable combination and location.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions, or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An apparatus for displaying a sign on a vehicle, comprising:

a main housing sleeve with right and left sleeves that extend along a length of the main housing sleeve, wherein the right and left sleeves of the main housing sleeve are separated to provide a recess that extends along the length of the main housing sleeve;

a receiving housing sleeve with right and left sleeves that extend along a length of the receiving housing sleeve, wherein the right and left sleeves of the receiving housing sleeve are separated to provide a recess that extends along the length of the receiving housing sleeve;

one or more first sleeve fasteners capable of being coupled to the main housing sleeve to fasten the main housing sleeve to the vehicle;

one or more second sleeve fasteners capable of being coupled to the receiving housing sleeve to fasten the receiving housing sleeve to the vehicle;

a main housing capable of being coupled to the main housing sleeve;

a receiving housing capable of being coupled to the receiving housing sleeve;

a winding mechanism coupled to the main housing;

a rollable vehicle sign capable of rolling and unrolling on the winding mechanism, a first end of the vehicle sign coupled to the winding mechanism and a second end coupled to the receiving housing;

wherein the main housing comprises an engagement protrusion that extends along a length of the main housing, wherein the engagement protrusion of the main housing is configured to slide into the recess of the main housing sleeve to couple the main housing to the main housing sleeve;

wherein the receiving housing comprises an engagement protrusion that extends along a length of the receiving housing, wherein the engagement protrusion of the receiving housing is configured to slide into the recess of the receiving housing sleeve to couple the receiving housing to the receiving housing sleeve;

wherein the rollable vehicle sign is displayable across a portion of the vehicle when the main housing is coupled to the main housing sleeve and the receiving housing is coupled to the receiving housing sleeve;

wherein the main housing comprises a cap at one end of the engagement protrusion;

wherein the cap of the main housing is configured to abut the main housing sleeve when the main housing is coupled to the main housing sleeve;

wherein the receiving housing comprises a cap at one end of the engagement protrusion;

wherein the cap of the receiving housing is configured to abut the receiving housing sleeve when the receiving housing is coupled to the receiving housing sleeve.

2. The apparatus of claim 1, wherein the rollable vehicle sign is extended and displayed upon coupling the main housing to the main housing sleeve and coupling the receiving housing to the receiving housing sleeve.

3. The apparatus of claim 1, further comprising:

a first handle coupled to the main housing; and a second handle coupled to the receiving housing.

4. The apparatus of claim 1, wherein the main housing and the receiving housing are capable of being fastened together using one or more housing fasteners.

5. The apparatus of claim 4:

wherein the one or more first sleeve fasteners can be selected from the group consisting of bolts, nuts, screws, magnets, clamps, clips, adhesive material, or any combination thereof;

wherein the one or more second sleeve fasteners can be selected from the group consisting of bolts, nuts, screws, magnets, clamps, clips, adhesive material, or any combination thereof;

wherein the one or more housing fasteners can be selected from the group consisting of bolts, nuts, screws, magnets, clamps, clips, adhesive material, or any combination thereof.

6. The apparatus of claim 1, wherein the apparatus is portable.

7. The apparatus of claim 1, wherein the right and left sleeves of the main housing sleeve are separated to provide a slotted opening to the recess of the main housing sleeve, wherein the slotted opening of the main housing sleeve extends along the length of the main housing sleeve;

wherein the right and left sleeves of the receiving housing sleeve are separated to provide a slotted opening to the recess of the receiving housing sleeve, wherein the slotted opening of the receiving housing sleeve extends along the length of the receiving housing sleeve.

8. A system for displaying a sign on a vehicle, comprising:
a main housing with an engagement protrusion that extends along a length of the main housing;
a main housing sleeve with a recess that extends along the length of the main housing sleeve;
a receiving housing with an engagement protrusion that extends along a length of the receiving housing;
a receiving housing sleeve with a recess that extends along a length of the receiving housing sleeve;
a winding mechanism coupled to the main housing;
a rollable vehicle sign capable of rolling and unrolling on the winding mechanism, a first end of the rollable vehicle sign coupled to the winding mechanism and a second end of the rollable vehicle sign coupled to the receiving housing;
wherein the engagement protrusion of the main housing is configured to slide into the recess of the main housing sleeve to couple the main housing to the main housing sleeve;
wherein the engagement protrusion of the receiving housing is configured to slide into the recess of the receiving housing sleeve to couple the receiving housing to the receiving housing sleeve;
wherein the main housing comprises a cap at one end of the engagement protrusion;
wherein the cap of the main housing is configured to abut the main housing sleeve when the main housing is coupled to the main housing sleeve;
wherein the receiving housing comprises a cap at one end of the engagement protrusion;
wherein the cap of the receiving housing is configured to abut the receiving housing sleeve when the receiving housing is coupled to the receiving housing sleeve.

9. The system of claim 8, wherein the main housing sleeve comprises first and second sleeves that extend along the length of the main housing sleeve and partially enclose the recess of the main housing sleeve;
wherein the receiving housing sleeve comprises first and second sleeves that extend along the length of the receiving housing sleeve and partially enclose the recess of the receiving housing sleeve;
one or more first sleeve fasteners that fasten the main housing sleeve to the vehicle;
one or more second sleeve fasteners that fasten the receiving housing sleeve to the vehicle.

10. The system of claim 9, wherein the main housing sleeve and the receiving housing sleeve are fastened to the vehicle such that they are spaced apart;
wherein the system is configured to display the vehicle sign upon coupling the main housing to the main housing sleeve and fastening the receiving housing to the receiving housing sleeve.

11. The system of claim 8, further comprising:
a first handle coupled to the main housing; and
a second handle coupled to the receiving housing.

12. The system of claim 8, wherein the main housing and the receiving housing are capable of being fastened together using one or more housing fasteners.

13. The system of claim 12:
wherein the one or more first sleeve fasteners can be selected from the group consisting of bolts, nuts, screws, magnets, clamps, clips, adhesive material, or any combination thereof;
wherein the one or more second sleeve fasteners can be selected from the group consisting of bolts, nuts, screws, magnets, clamps, clips, adhesive material, or any combination thereof,
wherein the one or more housing fasteners can be selected from the group consisting of bolts, nuts, screws, magnets, clamps, clips, adhesive material, or any combination thereof.

14. The system of claim 8, wherein the system is portable.

15. A method for displaying a sign on a vehicle, comprising:
fastening a main housing sleeve to the vehicle using one or more first sleeve fasteners;
fastening a receiving housing sleeve to the vehicle using one or more second sleeve fasteners;
coupling a main housing to the main housing sleeve by sliding an engagement protrusion of the main housing into a recess that extends along the main housing sleeve, wherein the engagement protrusion of the main housing extends along a length of the main housing, wherein the recess of the main housing sleeve extends along a length of the main housing sleeve, wherein the main housing comprises a winding mechanism with a rollable vehicle sign, wherein a first end of the rollable vehicle sign is coupled to the winding mechanism, wherein the main housing comprises a cap at one end of the engagement protrusion, wherein the cap of the main housing is configured to abut the main housing sleeve when the main housing is coupled to the main housing sleeve;
coupling a receiving housing to the receiving housing sleeve by sliding an engagement protrusion of the receiving housing into a recess that extends along the receiving housing sleeve, wherein the engagement protrusion of the receiving housing extends along a length of the receiving housing, wherein the recess of the receiving housing sleeve extends along a length of the receiving housing sleeve, wherein a second end of the rollable vehicle sign is coupled to the receiving housing, wherein the receiving housing comprises a cap at one end of the engagement protrusion, wherein the cap of the receiving housing is configured to abut the receiving housing sleeve when the receiving housing is coupled to the receiving housing sleeve;
displaying the rollable vehicle sign across a portion of the vehicle when the main housing is coupled to the main housing sleeve and the receiving housing is coupled to the receiving housing sleeve.

16. The method of claim 15:
wherein a first handle is coupled to the main housing; and
wherein a second handle is coupled to the receiving housing.

17. The method of claim 15, further comprising:
decoupling the main housing from the main housing sleeve;
decoupling the receiving housing from the receiving housing sleeve; and
coupling the main housing to the receiving housing one or more housing fasteners.

18. The method of claim 17, wherein an apparatus formed when coupling the main housing to the receiving housing is portable.

19. The method of claim 15:
wherein the one or more first sleeve fasteners can be selected from the group consisting of bolts, nuts, screws, magnets, clamps, clips, adhesive material, or any combination thereof;
wherein the one or more second sleeve fasteners can be selected from the group consisting of bolts, nuts, screws, magnets, clamps, clips, adhesive material, or any combination thereof;

wherein the one or more housing fasteners can be selected from the group consisting of bolts, nuts, screws, magnets, clamps, clips, adhesive material, or any combination thereof.

* * * * *